US011407089B1

(12) United States Patent
Diakite

(10) Patent No.: US 11,407,089 B1
(45) Date of Patent: Aug. 9, 2022

(54) TANKER FASTENER REMOVAL TOOL

(71) Applicant: Cheick O. Diakite, Philadelphia, PA (US)

(72) Inventor: Cheick O. Diakite, Philadelphia, PA (US)

( * ) Notice: Subject to any disclaimer, the term of this patent is extended or adjusted under 35 U.S.C. 154(b) by 292 days.

(21) Appl. No.: 16/817,088

(22) Filed: Mar. 12, 2020

(51) Int. Cl.
*B25B 13/50* (2006.01)
*B25G 1/10* (2006.01)

(52) U.S. Cl.
CPC ..... *B25B 13/5091* (2013.01); *B25G 1/102* (2013.01)

(58) Field of Classification Search
CPC ..... B25B 13/00; B25B 13/08; B25B 13/48; B25B 13/46; B25B 13/04; B25B 13/481; B25B 13/5091; B25B 23/0007; B25B 13/50; B25G 1/102; B25G 1/10; G10D 13/02; G10D 13/16
See application file for complete search history.

(56) References Cited

U.S. PATENT DOCUMENTS 549,871 A * 11/1895 Fowler ..... B25B 13/24 81/154
2,227,712 A 1/1941 Hackley
4,327,522 A 5/1982 Meadows
6,105,805 A 8/2000 Labelle et al.
6,196,590 B1 3/2001 Kim
6,394,496 B1 5/2002 Piona et al.
6,561,373 B1 5/2003 Chapin
7,055,440 B2 6/2006 Sisk
7,127,970 B2 * 10/2006 Kirchgaessler ..... B25B 13/5091 81/125
9,150,140 B2 10/2015 Girard et al.
10,906,160 B1 * 2/2021 Dickison ..... G10D 13/16
2001/0022118 A1 * 9/2001 Zollmann ..... B23B 31/201 81/176.15
2014/0260817 A1 * 9/2014 Wilson ..... B25B 13/5091 81/60
2019/0240818 A1 * 8/2019 Ettling ..... B25B 23/1427
2019/0346061 A1 * 11/2019 Shiner ..... B25B 13/48
2020/0122303 A1 * 4/2020 Amash ..... B23K 26/40

* cited by examiner

*Primary Examiner* — Robert J Scruggs
(74) *Attorney, Agent, or Firm* — Cramer Patent & Design, PLLC; Aaron R. Cramer

(57) ABSTRACT

A tanker fastener removal tool includes a ring and handle secured perpendicularly to one (1) end of the ring. Within the ring are disposed a pair of perpendicular rings of which each in turn as a protruding hook. The device is configured to secure about a fastener of a hatch access cover of a tanker truck.

10 Claims, 6 Drawing Sheets

TANKER FASTENER REMOVAL TOOL

RELATED APPLICATIONS

None.

FIELD OF THE INVENTION

The presently disclosed subject matter is directed to a removal tool and more specifically to a tanker fastener removal tool.

BACKGROUND OF THE INVENTION

There are countless tractor-trailer trucks that crisscross our country every day. These large vehicles bring just about every object we touch in our daily lives to use. Many of these trucks are tanker trucks that carry liquids which may be under pressure or vacuum.

On such vehicles is it often necessary to open flanges, hatches or other openings that are secured with large wingnuts, U-bolt assemblies, or similar fasteners. As the trucks move down the road, bounce over rough spots, and other continuously vibrate, these fasteners often settle in their position and become very difficult to remove when arriving at their destination.

Those workers who are young and strong often have great difficulty with these fasteners; those who may be elderly, disabled, or suffering from diminished strength may find them impossible to remove, thus relying on others or makeshift levers which sacrifice their safety. Accordingly, there exists a need for a means by which wingnuts, U-bolts and similar fasteners on tanker trucks can be easily loosened without the difficulties as described above. The development of the tanker fastener removal tool fulfills this need.

SUMMARY OF THE INVENTION

The principles of the present invention provide for a tool to assist in opening one or more access covers on a hatch which comprises a base section which has a pair of centered vertical supports with each of the pair of centered vertical support including a grab arm that angles downward. The tool to assist in opening one or more access covers also comprises a standoff which has a first end and a second end. The first end of the standoff is attached to a handle and the second end of the standoff is attached to an end of the base section.

The tool may assist in removing one or more wingnuts and one or more loop nuts used to hold each of the access covers on a corresponding access ports on tankers. The wingnuts may include two wings which are centered about a first threaded collar. The first threaded collar may be in mechanical contact with a first threaded stud. The physical contact may only occur between two "U"-shaped hooks and the two centered wings. Each of the grab arms may be provided with one of the two "U"-shaped hooks on each of their distal ends.

The hatch may include the planar access covers secured in position by the wingnuts. The tool may be made of high strength tool steel. The tool may be cast in one continuous segment. The cast may be machined to produce its final shape and one or more tolerances. The tool may be heat-treated to produce the necessary strength, flexibility, and rigidity. The tool may include a paint finish or a plating finish to prevent corrosion.

The tool may be utilized state with the loop nuts. The loop nuts may include a loop body which is connected to a second threaded collar that is in mechanical contact with a second threaded stud. The handle may be moved along a rotational travel path wherein rotational torque may be transferred from the handle to the base section and finally to the centered vertical supports. This provides increased leverage onto the loop body of the loop nuts and also easy removal of the loop nuts.

The loop nuts may be utilized in place of the wingnuts with equal effectiveness. The handle may be moved along a rotational travel path wherein rotational torque is transferred from the handle, to the base section, the centered vertical supports, to the grab arms and finally to the "U"-shaped hooks to provide increased leverage onto the two centered wings of the wingnuts for removal of the wingnuts. An upper end of the handle may include an ergonomic knob to allow for comfortable gripping while allowing the handle to spin. The ergonomic knob atop the handle may be spherical.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
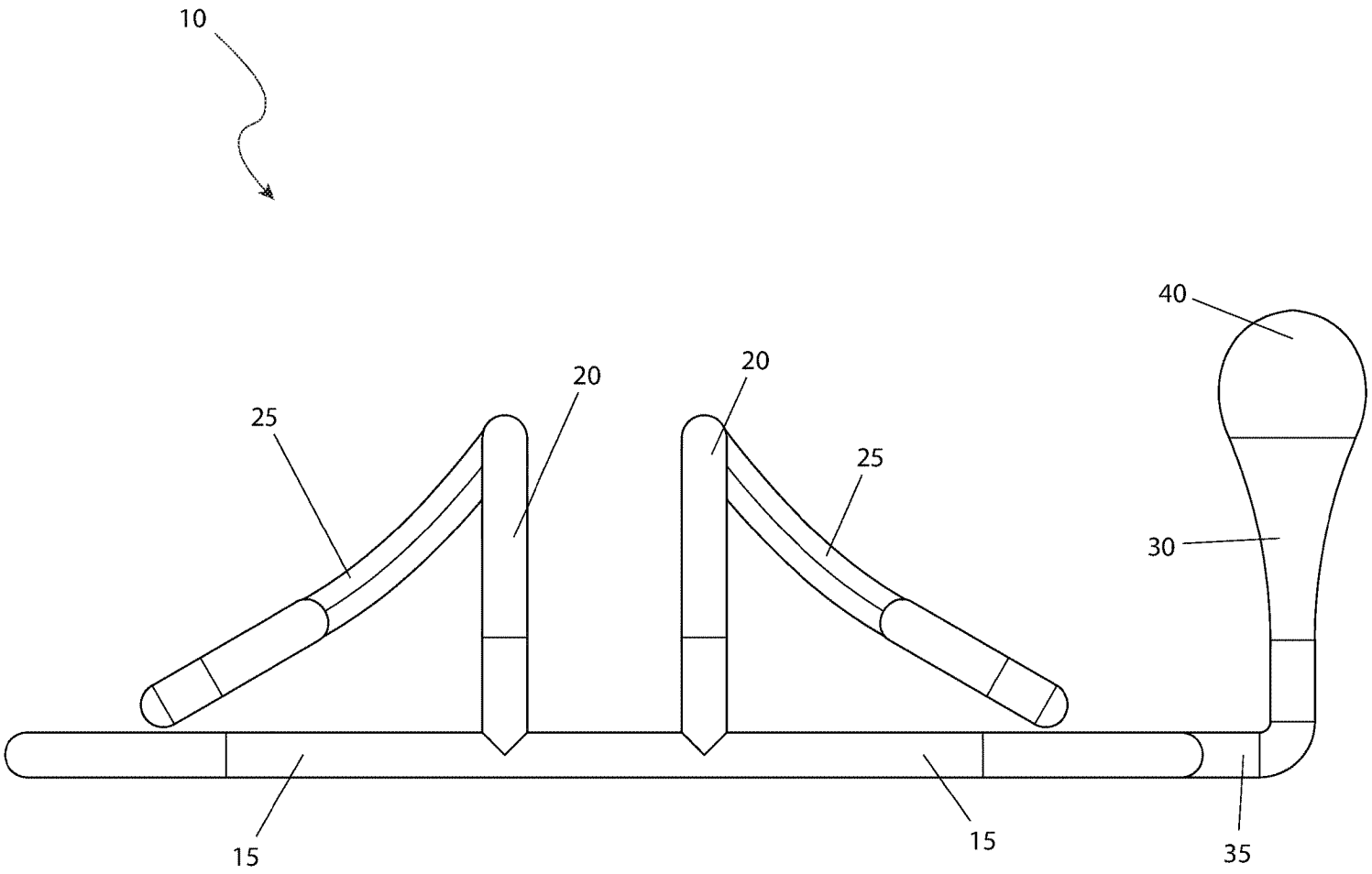
FIG. 1 is a front view of the tool 10 to assist in opening access covers 100 on a hatch 95, according to the preferred embodiment of the present invention.

10 tool
15 base section
20 vertical support
25 grab arm
30 handle
35 standoff
40 knob
45 "U"-shaped hook
50 wingnut
55 wing
60 first threaded collar
65 first threaded stud
70 rotational travel path "r"
75 loop nut
80 loop body
85 second threaded collar
90 second threaded stud
95 hatch
100 access cover

DESCRIPTION OF THE PREFERRED EMBODIMENTS

The best mode for carrying out the invention is presented in terms of its preferred embodiment, herein depicted within FIGS. 1 through 6. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

DETAILED DESCRIPTION OF THE FIGURES

Referring now to FIG. 1, a front view of the tool 10 to assist in opening access covers 100 on a hatch 95, according to the preferred embodiment of the present invention is disclosed. The tool 10 is used to assist in the removal of large wing nuts and loop nuts used to hold covers on access ports on tankers. The tool 10 provides for a base section 15 from which two (2) vertical supports 20 near the center. Each vertical support 20 is provided with a grab arm 25 that angles downward as shown. One (1) end of the tool 10 is provided with a handle 30 that attaches to a standoff 35. The upper end of the handle 30 is provided with an ergonomic knob 40 to allow for comfortable gripping in one hand by the user while allowing the handle 30 to spin. Such operation of the handle 30 as well as the tool 10 will be greater described herein below.

Figure 2:
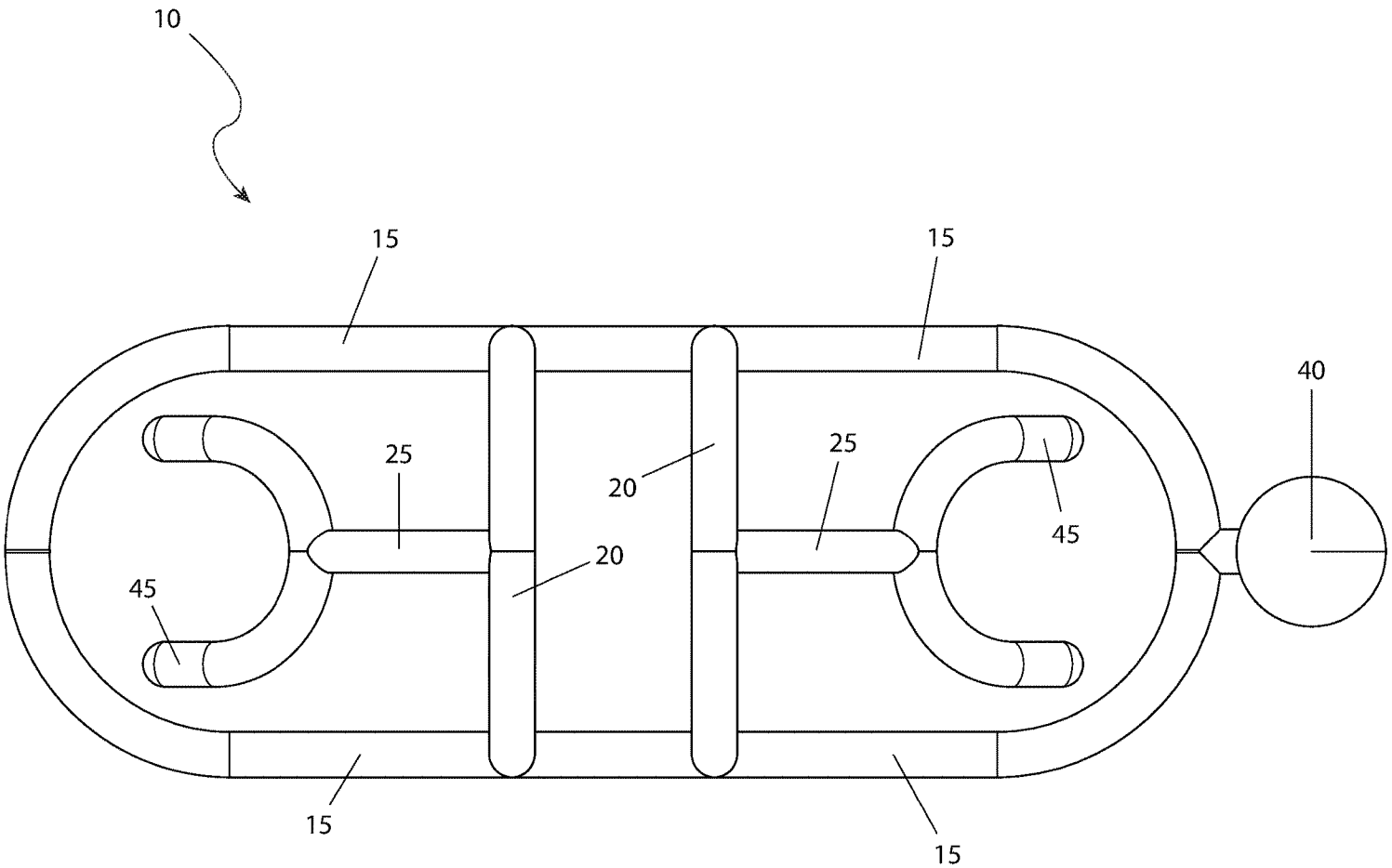
FIG. 2 is a top view of the tool 10 to assist in opening access covers 100 on a hatch 95, according to the preferred embodiment of the present invention.

Referring next to FIG. 2, a top view of the tool 10, according to the preferred embodiment of the present invention is depicted. This view provides more clarity regarding the arrangement of the vertical supports 20 on the base section 15. Each of the grab arms 25 are provided with a "U"-shaped hook 45 on its distal end as shown. The knob 40 atop the handle 30 (not shown due to illustrative limitations) discloses its spherical configuration. The base section 15 has a tubular elongated oval shape.

Figure 3:
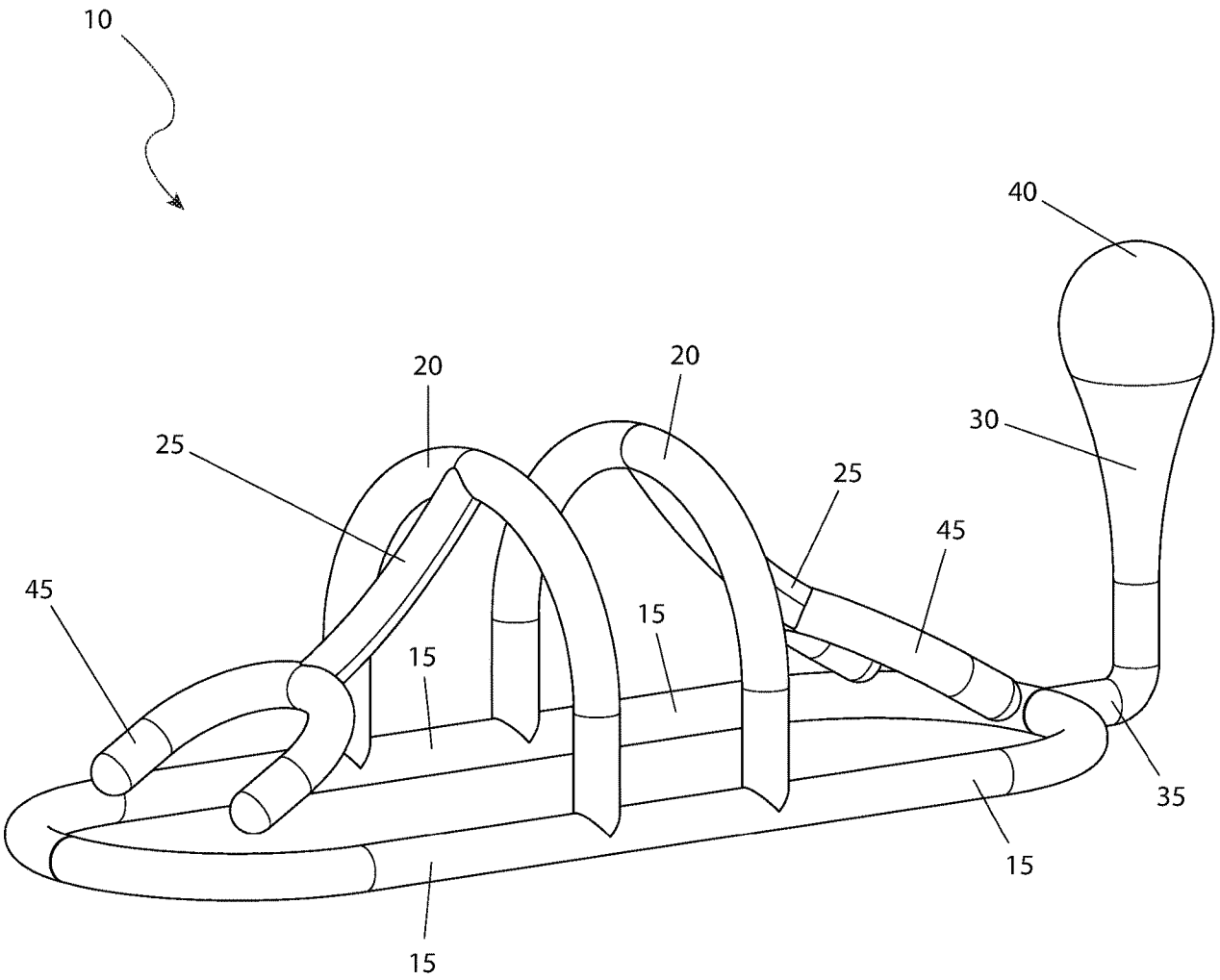
FIG. 3 is a perspective view of the tool 10 to assist in opening access covers 100 on a hatch 95, according to the preferred embodiment of the present invention.

Referring now to FIG. 3, a perspective view of the tool 10, according to the preferred embodiment of the present invention is shown. The components of the tool 10 including the base section 15, the vertical supports 20, the grab arms 25, the handle 30, the standoff 35, the knob 40, and the "U"-shaped hooks 45 are all made of high strength tool steel. It is envisioned that the tool 10 would be cast in one (1) continuous segment. The casting is envisioned to then be machined to produce its final shape and tolerances. Next, the tool 10 would be heat treated to produce the necessary strength, flexibility, and rigidity. A suitable finish such as paint or plating would be applied to prevent corrosion. The handle 30 is a vertical handle.

Figure 4:
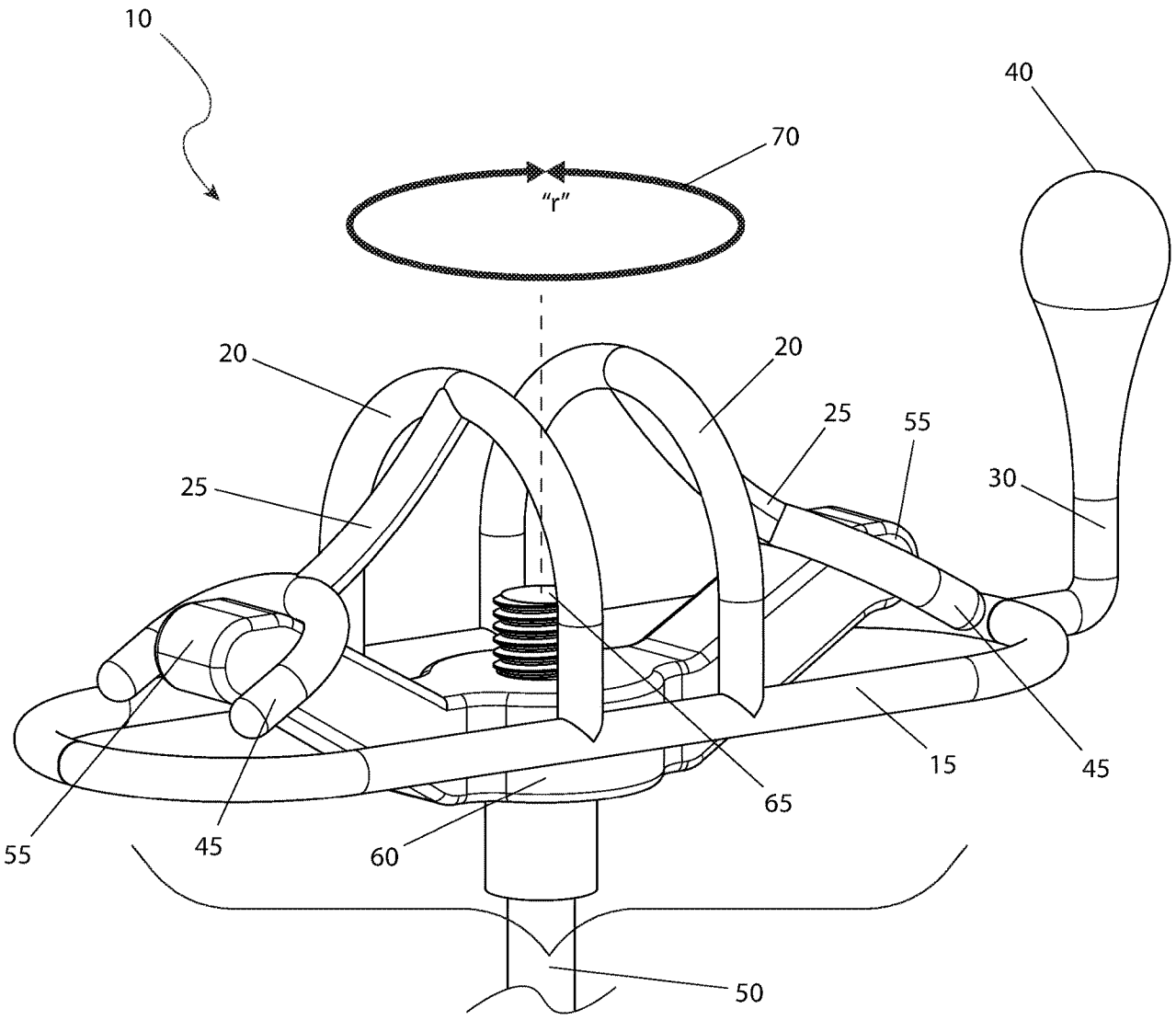
FIG. 4 is a perspective view of the tool 10 to assist in opening access covers 100 on a hatch 95, shown in a utilized state with a wingnut 50, according to the preferred embodiment of the present invention.

Referring next to FIG. 4, a perspective view of the tool 10, shown in a utilized state with a wingnut 50, according to the preferred embodiment of the present invention is disclosed. The wingnut 50 comprises two (2) wings 55 centered about a first threaded collar 60. The first threaded collar 60 is in mechanical contact with a first threaded stud 65. The only physical contact between the tool 10 and the wingnut 50 occurs between the two (2) "U"-shaped hooks 45 and the two (2) corresponding wings 55. Thus, as the handle 30 is moved along a rotational travel path "r" 70, rotational torque is transferred from the handle 30, to the base section 15, the vertical supports 20, to the grab arms 25 and finally to the "U"-shaped hooks 45. The mechanical connection then provides increased leverage onto the wings 55 of the wingnut 50. This torque results in increased leverage and greater mechanical advantage for removal of the wingnut 50.

Figure 5:
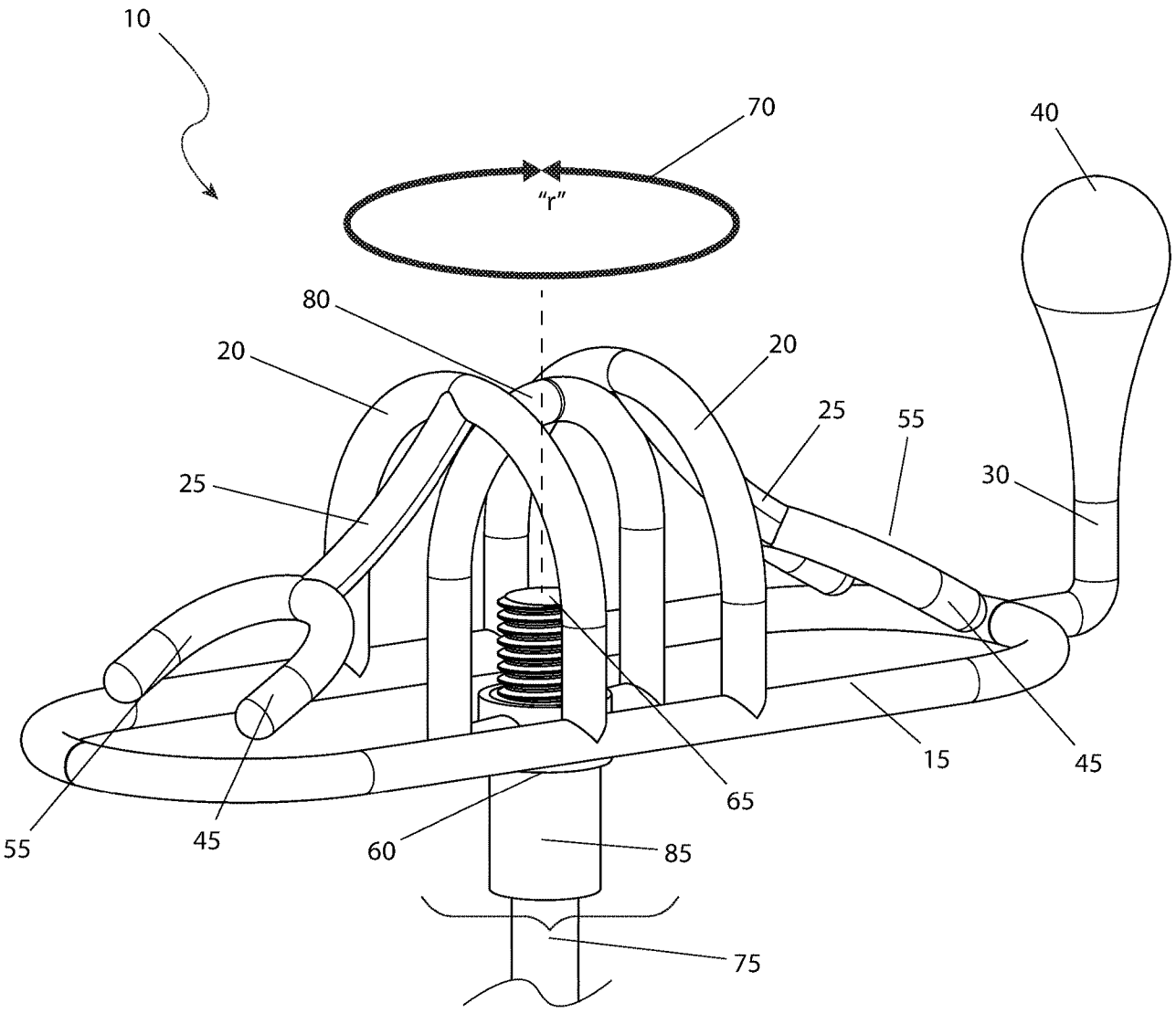
FIG. 5 is a perspective view of the tool 10 to assist in opening access covers 100 on a hatch 95, shown in a utilized state with a loop nut 75, according to the preferred embodiment of the present invention; and, FIG. 6 is a perspective view of the tool 10 to assist in opening access covers 100 on a hatch 95, shown in a utilized state, according to the preferred embodiment of the present invention.

Referring now to FIG. 5, a perspective view of the tool 10, shown in a utilized state with a loop nut 75, according to the preferred embodiment of the present invention is depicted. The loop nut 75 comprises a loop body 80 connected to a second threaded collar 85. The second threaded collar 85 is in mechanical contact with a second threaded stud 90. The only physical contact between the tool 10 and the loop nut 75 occurs between the two (2) vertical supports 20 and the two (2) side members of the loop body 80. Thus, as the handle 30 is moved along a rotational travel path "r" 70, rotational torque is transferred from the handle 30, to the base section 15, and finally to the vertical supports 20. The mechanical connection then provides increased leverage onto the loop body 80 of the loop nut 75. This torque results in increased leverage and easy removal of the loop nut 75.

Figure 6:
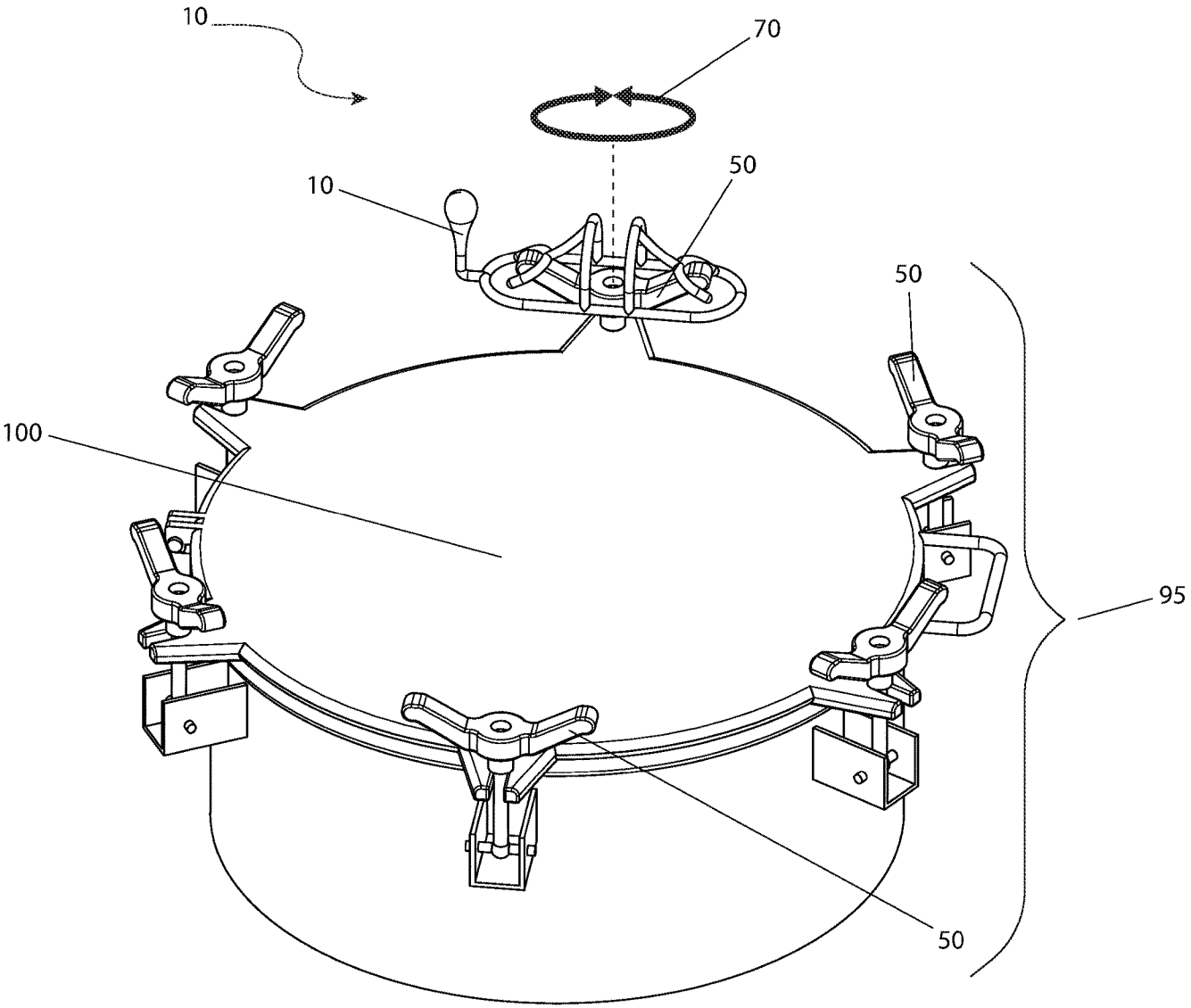

Referring to FIG. 6, a perspective view of the tool 10, shown in a utilized state, according to the preferred embodiment of the present invention is shown. The tool 10 is utilized upon a hatch 95 such as used upon a tank, a tanker truck, a manway, or the like. The hatch 95 consists of a planar access cover 100 secured in position by multiple wingnut 50. It is noted that loop nut 75 (as shown in FIG. 5) could be utilized in place of the wingnut 50 with equal effectiveness. The tool 10 is placed over each wingnut 50 in a sequential manner and operated along the rotational travel path "r" 70 to loosen the wingnut 50. Operation with the loop nut 75 (in lieu of the wingnut 50 as shown) is similar. While it is envisioned that the tool 10 would be used specifically for removal of the wingnut 50 (or loop nut 75), the tool 10 may also be used to ensure such fasteners are properly tightened upon reapplication as well.

OPERATION OF THE PREFERRED EMBODIMENT

The preferred embodiment of the present invention can be utilized by the common user in a simple and effortless manner with little or no training. It is envisioned that the tool 10 would be constructed in general accordance with FIG. 1 through FIG. 6. The user would procure the tool 10 from conventional procurement channels such as mechanical supply houses, trucking equipment suppliers, mail order and internet supply houses and the like. The tool 10 would be stored nearby any hatch 95 using wingnut 50 or loop nut 75 as the securing means.

During utilization of the tool 10, the following procedure would be initiated: in the case of a hatch 95 secured with multiple wingnut 50, the tool 10 is placed over each wingnut 50 as shown in FIG. 4; the "U"-shaped hooks 45 would be positioned to engage the wings 55; next, the user would grab the handle 30 in one (1) hand, and utilizing the knob 40, spin the tool 10 along the rotational travel path "r" 70; once loosened, the tool 10 may be removed. In the case of a hatch 95 secured with multiple loop nut 75, the tool 10 is placed over each loop nut 75 as shown in FIG. 5; the vertical supports 20 would be positioned to engage the loop body 80; next, the user would grab the handle 30 in one (1) hand, and utilizing the knob 40, spin the tool 10 along the rotational travel path "r" 70; once loosened, the tool 10 may be removed.

After use of the tool 10, it is simply stored until needed again for various tightening or removal activities in a repeating and cyclical manner.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A tool, comprising:

a base section having a pair of centered vertical supports, each of the pair of centered vertical support includes a grab arm that angles downward, the base section is a tubular elongated oval shape;

a standoff having a first end and a second end, the first end of the standoff is attached to a vertical handle and the second end of the standoff is attached to an end of the base section; and a U-shaped hook disposed on a distal end of each of the pair of grab arms;

wherein an upper end of the vertical handle includes an ergonomic knob to allow for gripping while allowing the vertical handle to spin; and wherein the ergonomic knob atop the vertical handle is spherical.

2. The tool according to claim 1, wherein physical contact only occurs between the pair of U-shaped hooks and the two centered wings.

3. The tool according to claim 1, wherein the tool is made of high strength tool steel.

4. The tool according to claim 3, wherein the tool is cast in one continuous segment.

5. The tool according to claim 4, wherein the cast is machined to produce its final shape and one or more tolerances.

6. The tool according to claim 5, wherein the tool is heat-treated to produce the necessary strength, flexibility, and rigidity.

7. The tool according to claim 1, wherein the tool includes a paint finish to prevent corrosion.

8. The tool according to claim 1, wherein the tool includes a plating finish to prevent corrosion.

9. The tool according to claim 1, wherein the tool is utilized state with a plurality of loop nuts.

10. The tool according to claim 1, wherein as the vertical handle is moved along a rotational travel path, rotational torque is transferred from the vertical handle to the base section, the centered vertical supports, to the grab arms and finally to the pair of U-shaped hooks to provide increased leverage onto the two centered wings of the wingnuts for removal of the wingnuts.

* * * * *